US006460526B1

(12) United States Patent
Ward

(10) Patent No.: US 6,460,526 B1
(45) Date of Patent: Oct. 8, 2002

(54) ELECTRONIC DISTRIBUTOR AND METHOD OF OPERATING SAME

(75) Inventor: Lance M. Ward, Lansing, MI (US)

(73) Assignee: TCI Automotive, L.L.C., Memphis, TN (US)

( * ) Notice: Subject to any disclaimer, the term of this patent is extended or adjusted under 35 U.S.C. 154(b) by 0 days.

(21) Appl. No.: 09/705,023

(22) Filed: Nov. 2, 2000

(51) Int. Cl.[7] ..... F02P 7/077
(52) U.S. Cl. ..... 123/612; 123/643
(58) Field of Search ..... 123/406.62, 595, 123/612, 613, 617, 643

(56) References Cited

U.S. PATENT DOCUMENTS

| | | | | |
|---|---|---|---|---|
| 4,170,209 A | | 10/1979 | Petrie et al. | 123/148 |
| 5,196,793 A | * | 3/1993 | Good et al. | 324/207.25 |
| 5,619,968 A | * | 4/1997 | Hillsberg et al. | 123/417 |
| 5,749,346 A | | 5/1998 | Halvorson et al. | 123/486 |
| 5,775,296 A | | 7/1998 | Goras et al | 123/417 |

* cited by examiner

*Primary Examiner*—Andrew M. Dolinar
*Assistant Examiner*—Johnny H. Hoang
(74) *Attorney, Agent, or Firm*—Clark Hill PLC

(57) ABSTRACT

A method is disclosed for controlling spark distribution for an internal combustion engine. The method incorporates the use of an electronic distributor that is capable of being used with a number of internal combustion engines. The electronic distributor receives signals from the crankshaft and the camshaft with respect to their respective locations to identify which of the cylinders is to have the fuel found therein ignited. The electronic distributor is versatile because it uses the crankshaft position sensor as a clock signal. This enables the electronic distributor to be timed with any engine control unit/internal combustion engine combination having the same required inputs as the electronic distributor has outputs. Further, an electronic distributor is disclosed having an engine selection device that matches a counter incorporated into the electronic distributor to the internal combustion engine. This allows the electronic distributor to be retrofit to be utilized by a plurality of internal combustion engines. The engine selection device determines what type of internal combustion engine it is being incorporated into and what type of signals are being received from the sensors used to identify the rotational position of the camshaft and the crankshaft.

8 Claims, 7 Drawing Sheets

ELECTRONIC DISTRIBUTOR AND METHOD OF OPERATING SAME

BACKGROUND OF THE INVENTION

1. Field of the Invention

The invention relates to electronic controls of an internal combustion engine. More specifically, the invention relates to a method for adapting an electronic controller to be used in multiply configured internal combustion engines.

2. Description of the Related Art

Electronic distributors are becoming ubiquitous in the automotive environment. Many of these systems are designed by the automotive manufacturer. These electronic distributors are not modifiable nor adjustable by the owner. Further, the electronic distributors are dedicated to a particular environment, i.e., a particular internal combustion engine, and a particular vehicle. In order to enter into an aftermarket or replacement market, an electronic distributor for every automobile/internal combustion engine combination must be made. This is cost prohibitive. Further, it is not possible to modify the OEM electronic distributors, thus preventing enthusiasts from modifying their automobiles to enhance performance. Further still, there is no technology for retrofitting internal combustion engines that were designed before the electronic distributor was incorporated therein.

SUMMARY OF THE INVENTION

An electronic distributor controls spark distribution for an internal combustion engine. The internal combustion engine includes a crankshaft, a camshaft and a plurality of cylinders, each having a coil and a spark plug. The electronic distributor includes a crankshaft position sensor to determine a rotational position of the crankshaft. The crankshaft position sensor outputs a crank position signal. The electronic distributor also includes a camshaft position sensor to determine a rotational position of the camshaft. The camshaft position sensor outputs a cam position signal. A counter is electrically connected to the crankshaft position sensor and the camshaft position sensor. The counter outputs a firing signal to be distributed to each of the plurality of cylinders. The electronic distributor also includes an engine selection device to match the counter with the internal combustion engine hosting the electronic distributor. The ability to match the two allows the counter to synchronize with the internal combustion engine and provide the firing signal to each of the plurality of cylinders at an appropriate time.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
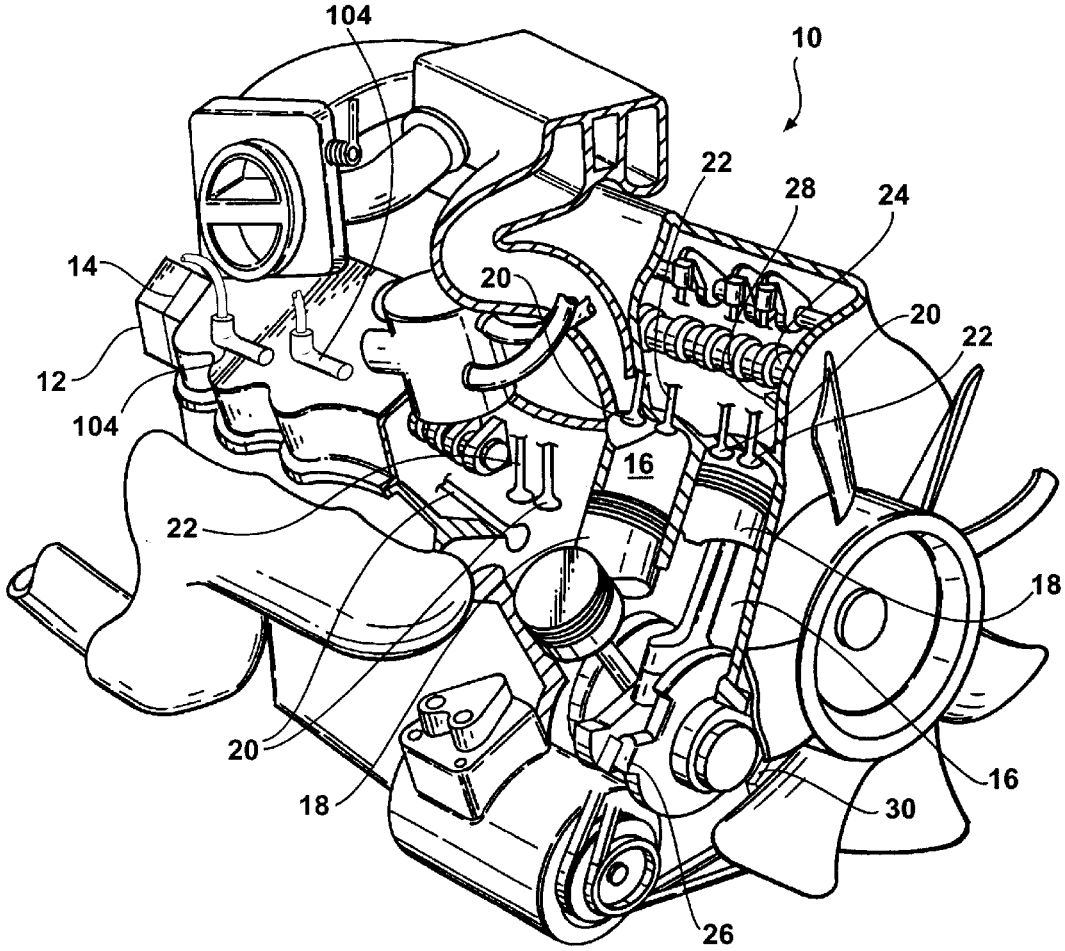
FIG. 1 is a perspective view of an internal combustion engine, partially cut away, incorporating one embodiment of the invention.

Referring to FIG. 1, a perspective view partially cut away of an engine for a motor vehicle is generally indicated at 10. The engine 10 is an internal combustion engine. The internal combustion engine 10 includes an electronic distributor 12 for operation with an electronic fuel injector system (not shown). The internal combustion engine 10 is controlled by the engine control unit 14. The electronic distributor 12 is shown fixedly secured to the engine control unit ("ECU") 14. It may be appreciated to those skilled in the art that the electronic distributor 12 may be located a distance from the ECU 14. The ECU 14 provides all electrical and electronic communication between the various subsystems of the internal combustion engine 10 and other systems of the motor vehicle (none shown).

The internal combustion engine 10 also includes a plurality of cylinders 16, each having a piston 18 and at least one intake 20 and exhaust 22 valve combination per cylinder 16. The valves 20, 22 are moved by a camshaft 24 and the pistons 18 move a crankshaft 26. A camshaft sensor 28 and a crankshaft sensor 30 identify the rotational position of each of the camshaft 24 and crankshaft 26, respectively. It may be appreciated by those skilled in the art that the sensors could utilize any technology known in the art to identify the position and/or orientation of a rotating object as it moves through its rotation.

Figure 2:
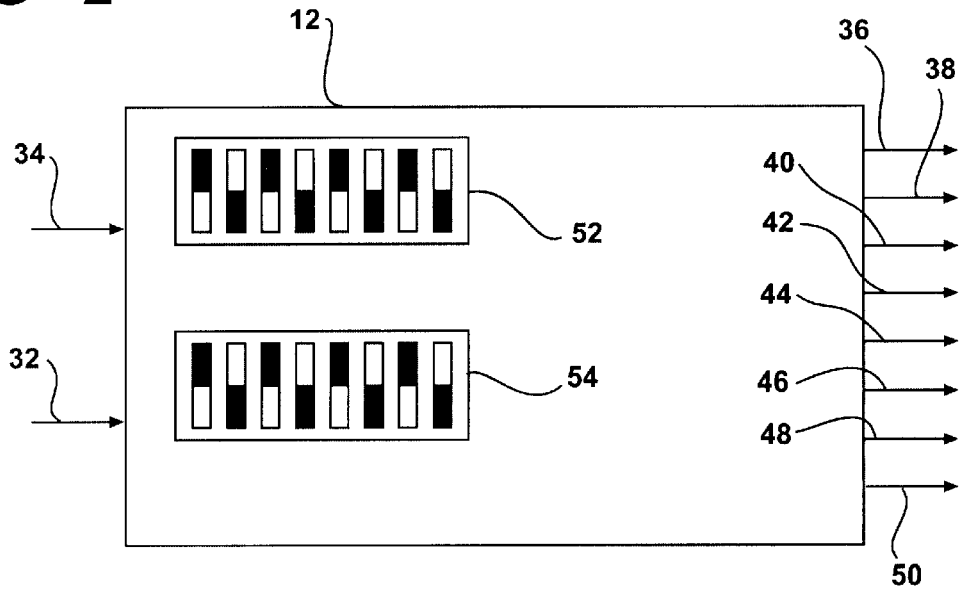
FIG. 2 is a schematic view of an electronic controller incorporating one embodiment of the invention.

Referring to FIG. 2, the electronic distributor 12 is shown. The electronic distributor 12 includes two input ports 32, 34. The two input ports 32, 34 receive signals from the camshaft sensor 28 and crankshaft sensor 30, respectively. In the embodiment shown in FIG. 2, the electronic distributor 12 also includes eight output ports 36–50. Each of the output ports 36–50 sends a signal to each of a set of spark plugs (none shown) that ignite the fuel in each of the cylinders 16 to generate an output force to rotate the crankshaft 26.

Figure 4:
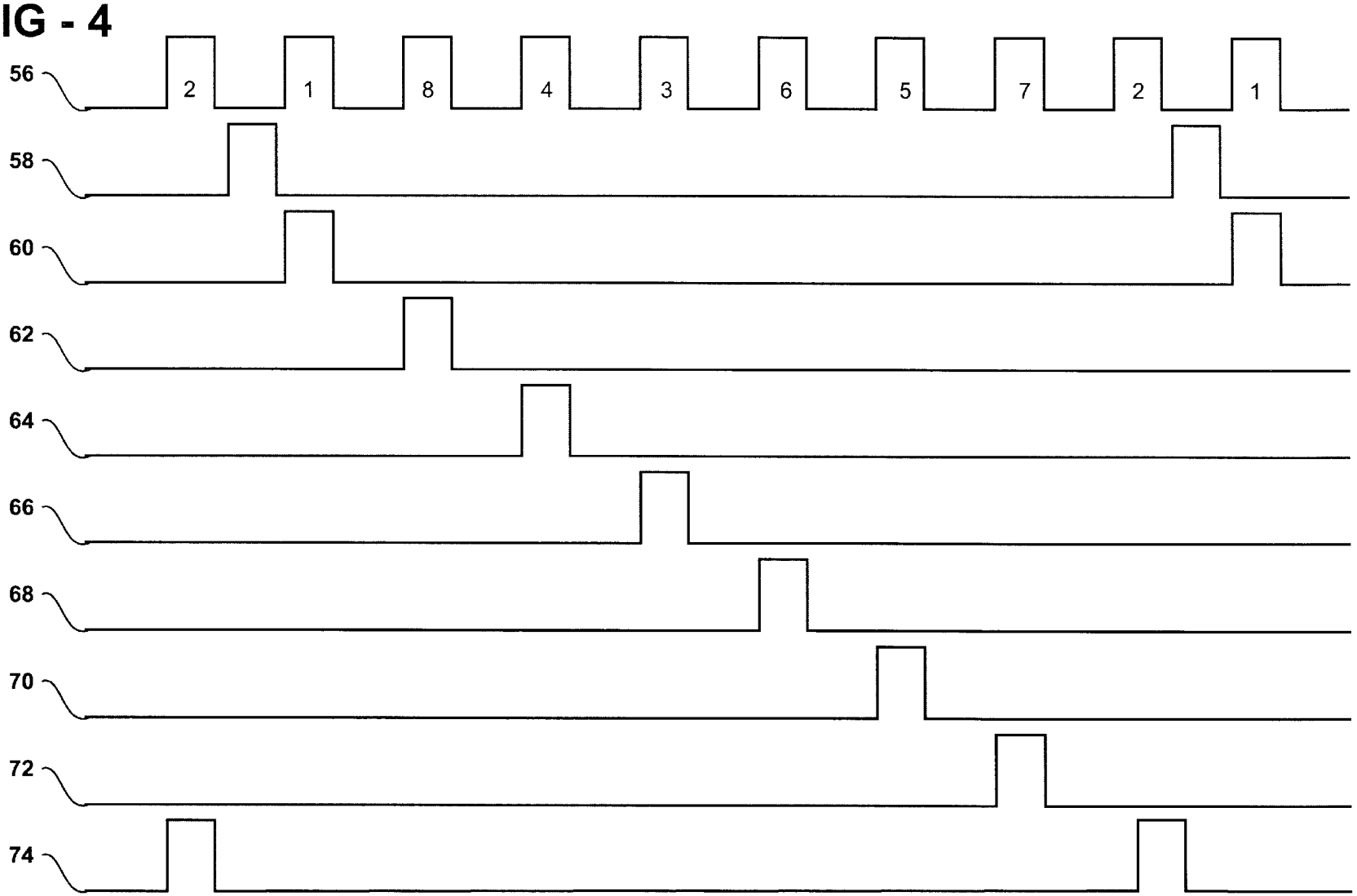
FIG. 4 is a timing diagram of the plurality of outputs of the electronic controller incorporating one embodiment of the invention.

The electronic distributor 12 also includes a switch assembly 52. In the preferred embodiment, the electronic distributor 12 includes two switch assemblies 52, 54. The switch assemblies 52, 54 are DIP switches that allow the electronic distributor 12 to be initialized to a specific internal combustion engine 10. By varying the positions of the individual switches on each of the DIP switches 52, 54, the electronic distributor 12 determines when the firing signals are transmitted and through which output port 36–50 the firing signal is to be sent. Referring to FIG. 4, a timing diagram shows the sequential output of the electronic distributor 12 as a function of time. The first line 56 represents the input associated with the rotational position of the crankshaft 26. It identifies which cylinder 16 is being fired. The second line 58 represents the input associated with the rotational position of the camshaft 26. This input identifies the portion of the cycle in which a particular cylinder 16 is operating. More specifically, the camshaft position signal identifies whether a particular cylinder 16 is moving through its intake stroke or its exhaust stroke. This signal is necessary because the crankshaft sensor will identify twice as many triggering events as is shown on the first line 56 because the crankshaft 28 rotates twice for every cylinder ignition. The remaining eight lines 60–74 each represent a signal being emitted from each of the output ports 36–50. The output signals are triggered by the positive edges of every pulse in the input signal associated with the crankshaft position signal defined by the first line 56. The output signal is received by the spark plug and the fuel in the cylinder 16 is ignited.

The camshaft position signal, identified by the second line 58 in FIG. 4, is utilized by the electronic distributor 12 for a second function. The camshaft position signal is used to clock the electronic distributor 12. This dual function of the camshaft position signal reduces the requirements for the electronic distributor 12 by using a signal inherent to the particular internal combustion engine 10 to run the electronic distributor 12. More specifically, the electronic distributor 12 is timed in unison with the internal combustion engine 10 and the ECU 14 by using an output of the internal combustion engine 10 as an input thereto.

Figure 3:
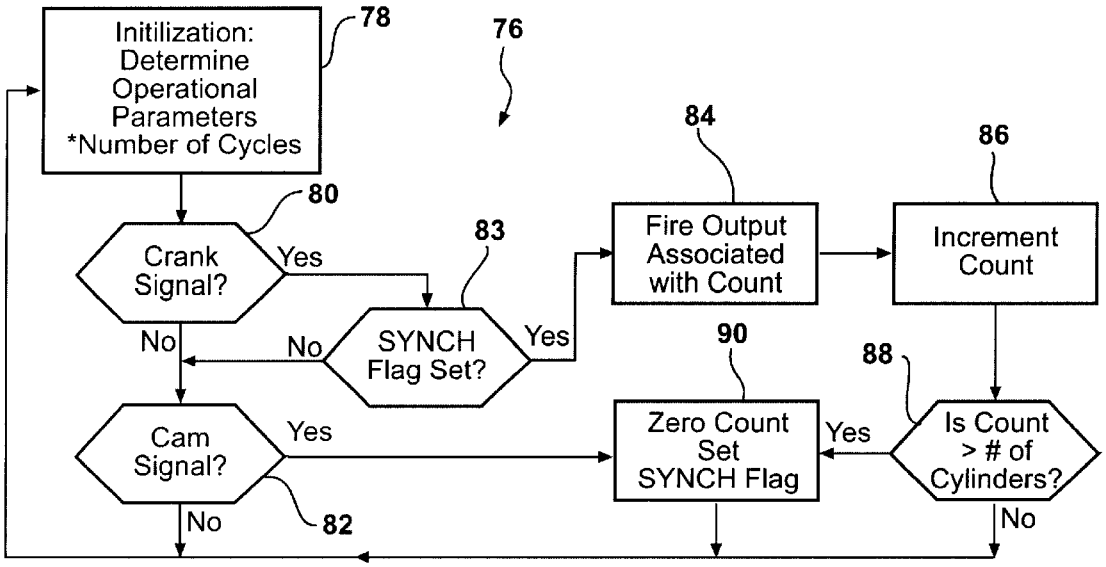
FIG. 3 is a flow chart of one embodiment of the inventive method.

Referring to FIG. 3, the method of operating the electronic distributor 12 is generally indicated at 76. The method 76 begins with an initialization step 78. This initialization step 78 allows the electronic distributor 12 to identify the configuration of the DIP switches 52, 54 so that it may determine the type of internal combustion engine 10 with which it has been connected. Once initialized, the method determines whether a crankshaft position signal is present at 80. If not, it determines whether a camshaft position signal is present at 82. If not, the method 76 loops back and tests each of the inputs 32, 34 again until a signal is present.

Once a crankshaft position signal is detected at 80, it is determined whether a synchronization flag is set at 83. If not, a determination as to whether a camshaft position signal is present at 82. If so, the output associated with the specific count is fired at 84. The count is then incremented at 86. It is then determined whether the newly incremented count is greater than the number of cylinders 16 for the particular internal combustion engine 10. This occurs at decision diamond 88. If not, the method 76 is looped back to decision diamond 80 to identify where in the crankshaft signal the method 76 is operating.

If it is determined at 88 that the count is greater than the number of cylinders 16, the count is zeroed and the synchronization flag is set at 90. Once these two events occur, the method 76 returns to decision diamond 80 to identify where in the crankshaft signal the method is operating.

If a crankshaft signal is not identified, but the camshaft signal is (step 82), the count is immediately zeroed at 90 and the method 76 is returned to decision diamond 80 to again identify the crankshaft position signal.

Figure 5:
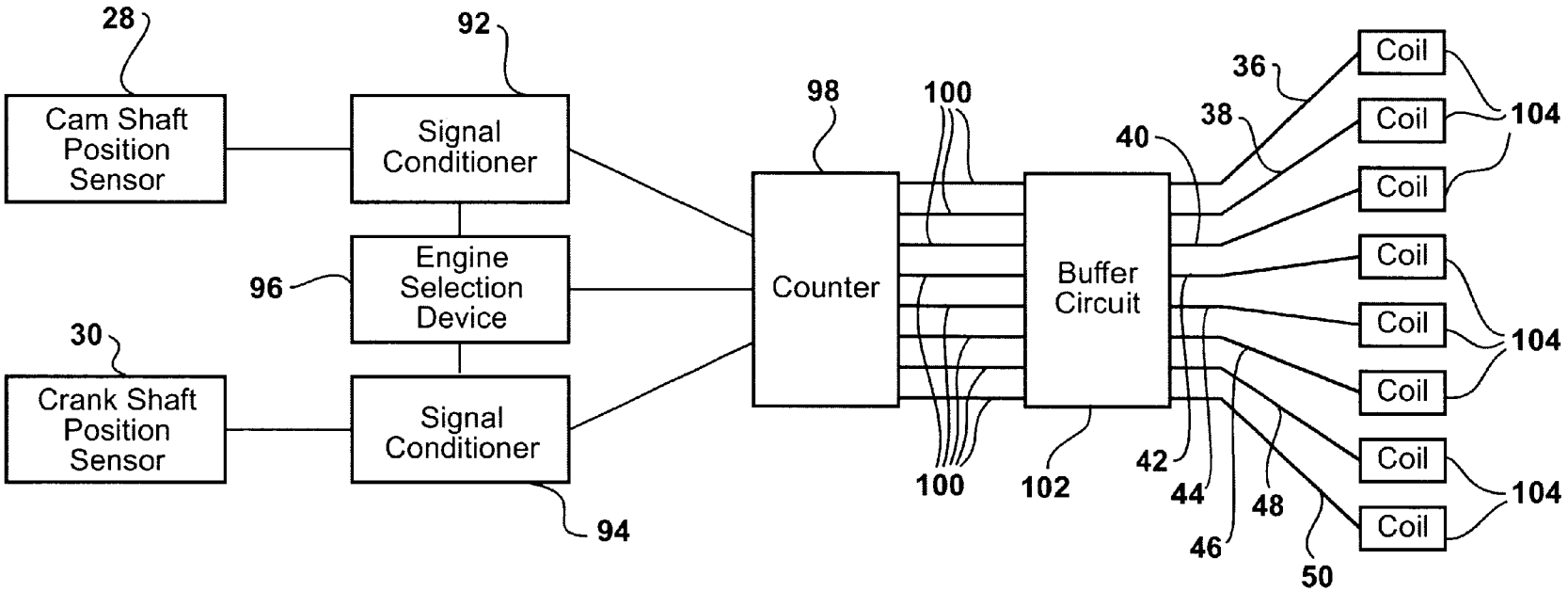
FIG. 5 is a block diagram of the electronic distributor according to the invention.

Referring to FIG. 5, a block diagram of the electronic distributor 12 is shown. The camshaft position sensor 28 and a crankshaft position sensor 30 are each electrically connected to a signal conditioner 92, 94. The position sensors 28, 30 provide information regarding the rotational orientation of each of the camshaft 24 and the crankshaft 26. The signal conditioners 92, 94 identify the type of signal being received from the camshaft position sensor 28 and the crankshaft position sensor 30. Depending on the type of signal, either analog or digital, the signal conditioners 92, 94 will operate appropriately to transmit the modified signals from the camshaft position sensor 28 and a crankshaft position sensor 30 to the remainder of the electronic distributor 12.

An engine selection device 96 is electrically connected between the signal conditioners 92, 94. The engine selection device 96 matches a counter 98 with the internal combustion engine 10 that is hosting the electronic distributor 12. More specifically, the engine selection device 96 identifies the number to which the counter 98 will count (step 88, discussed above). By matching the counter 98, discussed in greater detail subsequently, with the internal combustion engine 10, the counter 98 may be synchronized with the internal combustion engine 10. The engine selection device 96 identifies the number of cylinders 16 and timing issues related to the internal combustion engine 10 allowing the firing of the spark plugs in each of the cylinder 16 to occur at the appropriate time to maximize performance and/or efficiency.

The switch assembly 52 is a part of the electronic selection device 96. The switch assembly 52, 54, being DIP switches, allow the identification of any number of internal combustion engines 10. The remainder of the engine selection device 96 will be discussed in greater detail subsequently.

The counter 98 is electrically connected to each of a the two signal conditioners 92, 94 which are, in turn, electrically connected to the camshaft position sensor 28 and the crankshaft position sensor 30, respectively. The output of the counter 98 is a firing signal. The firing signal is a demultiplexed signal wherein each output lead 100 will eventually lead to a single spark plug (not shown).

The output lead 100 are received by a buffer circuit 102. The buffer circuit 102 converts the firing signals received over the output lead 100 into electrical signals suitable to be received by the coils 104. The coils 104 are the devices that drive the spark plugs. It should be appreciated by those skilled in the art that, while eight coils 104 are shown in FIG. 5, the number of coils 104 will equal the number of cylinders 16 in the internal combustion engine 10.

Figure 6A:
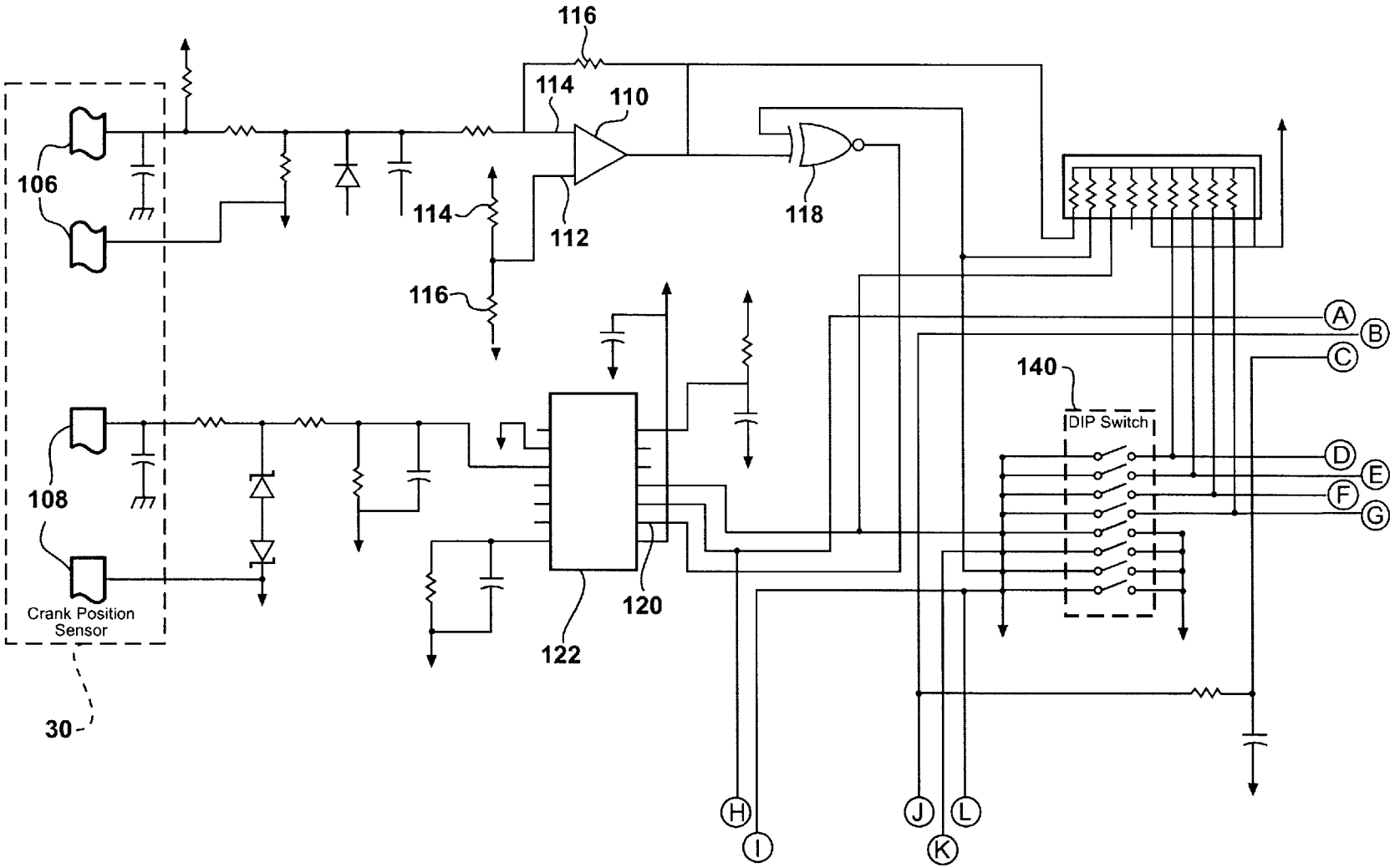
FIGS. 6A through 6C are electrical schematics of one embodiment of the electronic distributor according to the invention.
Figure 6B:
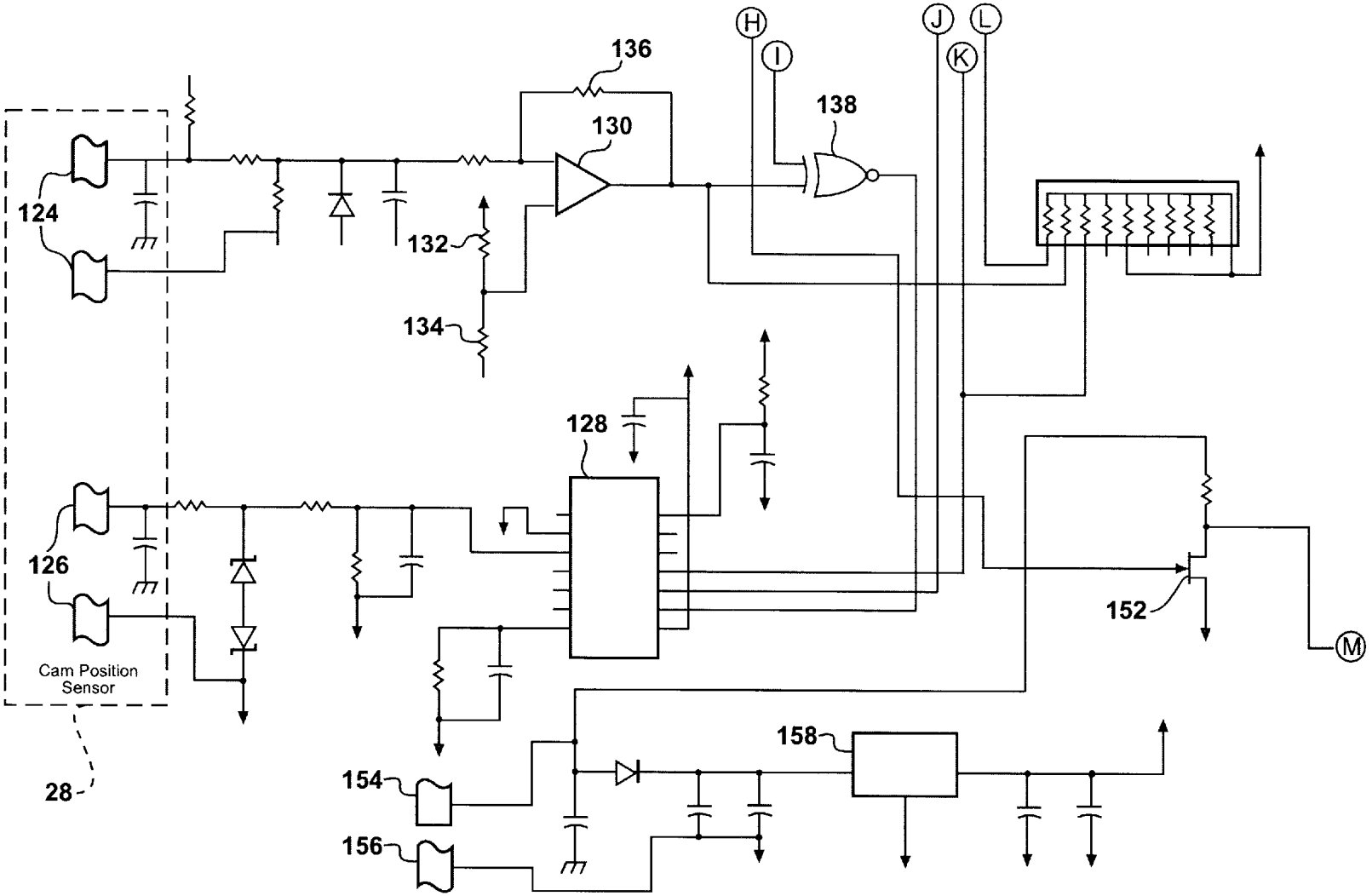

Referring to FIGS. 6A through 6B, a detailed electrical schematic of the block diagram shown in FIG. 5 is shown. With specific reference to FIG. 6A, the crank position sensor 30 includes two sets of inputs, digital inputs 106 and analog inputs 108. The digital inputs 106 are eventually connected to a comparator 110. The inverting inputs 112 of the comparator 110 is connected to a voltage divider including two resistors 114, 116. The non-inverting inputs 114 of the comparator 110 are connected to the digital inputs 106 and a feedback resistor 116. The output of the comparator 110 is received by a programmable inverter 118. The output of the programmable inverter 118 is connected to a pin 120 of an adaptive learn amplifier 122. The analog inputs 108 of the crank position sensor 30 are connected to the adaptive learn amplifier 122 through the various coupling elements.

Like the crank position sensor 30 shown in FIG. 6A, the cam position sensor 28 is shown in FIG. 6B. Digital inputs 124 and analog inputs 126 are connected to an adaptive learn amplifier 128 similarly to that described with the crank position sensor 30 and shown in FIG. 6A. Providing a means to retrieve data through analog and digital inputs associated with the respective position sensors 28, 30 maximizes the versatility with respect to the combinations of sensors and internal combustion engines 10 available in the marketplace. More specifically, the electronic distributor 12 may be used with any type of sensor designed to measure the rotational position of an object, either digital or analog, in combination with any internal combustion engine 10.

The digital inputs 124 of the cam position sensor 28 are connected, through coupling elements, to a comparator 130 having an inverting input connected to a voltage divider having resistors 132, 134 and a non-inverting input connected to the digital inputs 124 and a feedback resistor 136. The output of the comparator 130 is connected to a second programmable inverter 138.

Figure 6C:
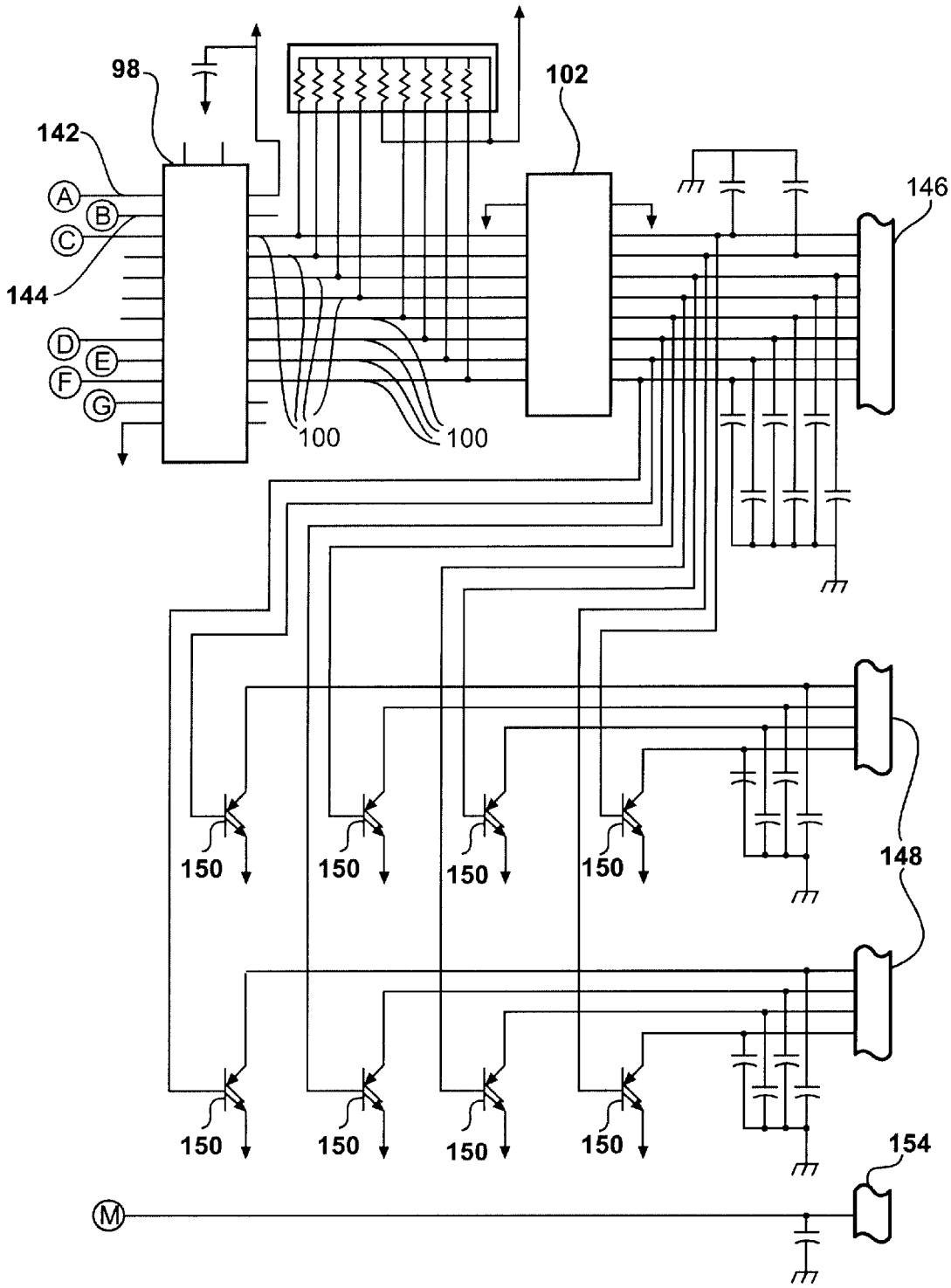

Switches 52, 54 are represented by a single bank of switches 140 in FIG. 6A. Outputs from the switches 140 and from the two adaptive learn amplifiers 122, 128 are received by the counter 98, shown in FIG. 6C. The counter 98 includes a lead 142 which is a clock input. The clock input 142 is received from the crank position sensor 30. A second lead 144 into the counter 98 is from the cam position sensor 28. These two inputs provide the timing for the counter 98 when it is attempting to provide the appropriate firing signals to the spark plugs through the coils 104.

The buffer circuit 102 received the outputs from the counter 98. The buffer circuit 102 receives the outputs through electrical connections 100. The outputs from the buffer circuit 102 through electrical connections 36–50 are sent, in parallel, to two sets of outputs 146, 148. The first set of outputs 146 represented outputs that are connected to smart coil connections. Smart coils merely need to receive a firing signal and they will discharge the appropriate voltage signal to generate a spark from the spark plug. Conversely, the coil connections 148 are connected to coils 104 that do not have the "smart" feature. Because of this, eight transistors 150 are connected to each of the output lines such. When their gates are opened, enough voltage may pass through the line to provide enough power to the individual coils 104 to generate a spark from the spark plug.

Referring back to FIG. 6C, a MOSFET transistor 152 is connected between an ignition switch input 154 and an output of the adaptive learn amplifier 122, indicating receiving a signal eventually from the crank position sensor 30. The MOSFET transistor 152 provides an output 154 which is connected to a tachometer (not shown). The ignition switch input 154 and a second input 156 hostile couple to a power supply 158 through various elements which is eventually received by the MOSFET transistor 152.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. An electronic distributor for controlling spark distribution for an internal combustion engine having a crankshaft, a camshaft and a plurality of cylinders each having a coil and a spark plug, said electronic distributor comprising:

a crankshaft position sensor to determine a rotational position of the crankshaft, said crankshaft position sensor outputting a crank position signal;

a camshaft position sensor to determine a rotational position of the camshaft, said camshaft position sensor outputting a cam position signal;

a counter electrically connected to said crankshaft position sensor and said camshaft position sensor, said counter outputting a firing signal to be distributed to each of the plurality of cylinders; and an engine selection device to identify one of a plurality of internal combustion engines such that said engine selection device synchronizes said counter with the one of the plurality of internal combustion engines hosting said counter to provide the firing signal to each of the plurality of cylinders at an appropriate time for the one of the plurality of internal combustion engines.

2. An electronic distributor as set forth in claim 1 including a cam signal conditioner electrically connected between said camshaft position sensor and said counter.

3. An electronic distributor as set forth in claim 2 including a crank signal conditioner electrically connected between said crankshaft position sensor and said counter.

4. An electronic distributor as set forth in claim 3 including a buffer circuit for buffering said firing signal to make said firing signal compatible with the coils and the spark plugs.

5. An electronic distributor as set forth in claim 4 wherein said engine selection device includes an adaptive learn amplifier to receive said crank position signal and said cam position signal.

6. An electronic distributor as set forth in claim 5 wherein said engine selection device further includes a switch assembly for identifying the internal combustion engine.

7. An electronic distributor as set forth in claim 6 including a plurality of transistors, each associated with one of the coils to provide voltage to the coils to power spark plugs.

8. A method for controlling spark distribution for an internal combustion engine having a crankshaft, a camshaft and a plurality of cylinders using an electronic controller having a plurality of inputs and outputs, the method comprising the steps of:

identifying the internal combustion engine;

setting the electronic controller based on the identification of the internal combustion engine such that the electronic controller operates the internal combustion engine;

receiving a crank position signal created by a crank position sensor disposed adjacent the crankshaft;

receiving a cam position signal created by a cam position sensor disposed adjacent the camshaft;

generating an output to be transmitted through one of the plurality of outputs based on the crank and cam position signals allowing gases in one of the plurality of cylinders to ignite; and clocking the electronic controller using the cam position signal.

* * * * *